US005452798A

United States Patent [19]

Kraft

[11] Patent Number: 5,452,798

[45] Date of Patent: Sep. 26, 1995

[54] MULTIPLE PACKAGING AND PROCESS FOR PACKAGING A MULTITUDE OF CONTAINERS

[75] Inventor: Lothar Kraft, Schwaig, Germany

[73] Assignee: Packmaster System Entwicklung GmbH, Ezelsdorf/Burgthann, Germany

[21] Appl. No.: 61,382

[22] Filed: May 14, 1993

[51] Int. Cl.[6] ..... B65D 85/00

[52] U.S. Cl. ..... 206/427; 206/192; 206/432

[58] Field of Search ..... 206/192, 193, 206/390, 394, 497, 427, 432

[56] References Cited

U.S. PATENT DOCUMENTS

| | | | |
|---|---|---|---|
| 2,912,102 | 11/1959 | Scott | 206/394 |
| 3,286,833 | 11/1966 | Chadbourne | 206/432 |
| 3,300,041 | 1/1967 | Fuller | 206/192 |
| 3,360,179 | 12/1967 | Carstens | 206/592 |
| 3,490,582 | 1/1970 | Farquhar | 206/432 |
| 3,613,881 | 10/1971 | Oldenburg | 206/192 |
| 4,077,516 | 3/1978 | Duerr | 206/497 |
| 4,116,331 | 9/1978 | Curry et al. | 206/497 |
| 4,300,681 | 11/1981 | Klygis et al. | 206/432 |

FOREIGN PATENT DOCUMENTS

| | | | |
|---|---|---|---|
| 1246907 | 10/1960 | France | 206/192 |
| 1398565 | 3/1965 | France . | |
| 2129213 | 10/1972 | France . | |
| 7421821 | 6/1974 | Germany . | |
| 8515888 | 8/1985 | Germany . | |
| 2025352 | 1/1980 | United Kingdom | 206/432 |

*Primary Examiner*—David T. Fidei
*Attorney, Agent, or Firm*—Browdy and Neimark

[57] ABSTRACT

The present invention relates to multiple packaging in the form of a one-piece or multi-piece blank of packaging materials for a plurality of containers are kept together so that they cannot be lost, wherein the blank consists of cardboard or tear-proof plastic and at least partially encloses the containers. For the attainment of the object, which consists in providing a novel multiple packaging which assures a considerable reduction of the packaging trash created by the packaging and thus a reduction of the amounts of packaging which must be accepted by the manufacturer, the invention proposes that the blank (5) be firmly connected, preferably glued, with each container (1) at least at one lateral surface, by means of which a display area (3) of the blank (5) is created, which is firmly connected with the container (1), the non-glued sections of the blank (5) form connecting links (6) between the adjoining containers (1), and the blank (5) can be separated in the area of the connecting links.

14 Claims, 5 Drawing Sheets

MULTIPLE PACKAGING AND PROCESS FOR PACKAGING A MULTITUDE OF CONTAINERS

FIELD OF THE INVENTION

The present invention relates to multiple packaging in the form of a one-piece or multi-piece blank of packaging materials for a plurality of containers, such as cans, bottles or bags, by means of which the containers are kept together so that they cannot be lost, wherein the blank consists of cardboard or tear-proof plastic and at least partially encloses the containers. The invention furthermore relates to a process for packaging a plurality of containers, in particular using the multiple packaging in accordance with the invention.

BACKGROUND OF THE INVENTION

Because of continuously more stringent laws regarding trash, the question of how to reduce the amount of packaging trash has become more and more important in the field of the packaging industry. This question is also important because the new rules state that the manufacturer is required to take back the packaging trash created in the course of selling his goods. Up to now, throw-away packaging was used for packaging a multitude of containers, such as beer cans, which are discarded as trash directly after use and are the cause of the resulting enormous amount of so-called packaging trash. Furthermore, so-called paper or cardboard recycling is no longer as advantageous as it used to be, because today an extremely large amount of paper and cardboard is generated, with the result that these amounts of paper and cardboard can no longer be completely processed.

It is the object of the present invention to provide a novel multiple packaging which assures a considerable reduction of the packaging trash resulting from packaging and thus a reduction of the amounts of packaging which have to be accepted back by the manufacturer.

In accordance with the invention, this object is attained in that the blank is firmly connected, preferably glued, with each container at least at one lateral surface, by means of which a display area of the blank is provided which is firmly connected with the container. The non-glued sections of the blank form connecting links between the adjoining containers and the blank can be separated in the area of the connecting links.

The invention is based on the concept of using at least a part of the packaging as a display surface, i.e. for the marking of containers required by the labeling laws. The display area remains connected with the containers when cutting the respective connecting links. The print and advertising areas provided in the display areas remain on the container. Thus, no or only a small amount of packaging trash is generated when separating the multiple packaging. In addition, the multiple packaging of the invention offers the advantage that the containers to be packaged need no longer be individually labeled. Labeling and multiple packaging take place in a single production step. By means of this the manufacturing costs are considerably decreased, in addition to the savings in packaging trash.

In a particular embodiment of the invention, the blank has a plurality of containers in a single file. The multiple packaging, i.e. bundle, thus is in the form of a chain, from which the containers can be separated as needed.

Furthermore, it has been provided by the invention that the blank encloses the lateral areas of the container over their full circumference, because of which particularly large display surfaces are created and at the same time a particularly great stability of the bundle is assured.

Alternatively to this, a further embodiment of the packaging of the invention is distinguished in that the blank encloses the lateral parts only over a portion of the circumference, preferably only over one half. By means of this step it is possible to assure, particularly in view of packaging trash, a savings in needed packaging material, while sufficient display surfaces still remain. Furthermore, the application of the packaging is particularly simple in this embodiment, because the containers only need to be labeled on one side.

The containers are suitably arranged perpendicularly to the longitudinal direction of the row. In this case, separation of the packaging takes place along the lateral surface in the longitudinal direction of each container. This embodiment has a particularly high degree of lateral mobility of the bundle, which might be of interest in connection with certain types of stacking or storage.

A packaging in accordance with the invention which is particularly original from the viewpoint of its arrangement is distinguished in that the containers are arranged, resting with their respective fronts on each other, parallel to the longitudinal direction of the row. For one thing, packaging embodied in this way is relative simple to store, for another, it is possible by means of this to offer packs of three which are very effective for advertising, for example as a "tower". Separation of the individual containers takes place along the circumference.

SUMMARY OF THE INVENTION

A further embodiment in accordance with the invention is distinguished in that the blank encloses a multi-link bundle of containers. In this case the blank encloses an arrangement of, for example, four containers, the blank being fixedly connected with the outsides of the containers. These fixedly connected sections of the blank remain on the container as display surfaces, even if the respective container has been separated from the packaging, i.e. the bundle.

The blank can be put under a tension which further increases the rigidity or stability of the entire packaging. In the course of this the containers, in accordance with the invention, touch each other at least partially in the packaged state and absorb the pressure applied by the blank.

To increase the stability of the packaging still further, it is provided by the invention that the blank has support straps in the area of the connecting links, which can be folded between the containers located next to each other. These lateral extensions simultaneously form support links between the respectively adjoining containers.

In a further embodiment of the invention the support straps have a shape adapted to the exterior of the containers, for example a curvature or arching, because of which the support effect is improved. In a useful way the support straps are provided on both sides and/or the interior of the connecting link 6. In this way an optimum stability of the bundle is achieved. The support straps provided in the interior of the connecting link can be folded on top of each other and in this way form a single, double-walled support tab having a particularly stabilizing effect.

A particular embodiment of the packaging in accordance with the invention is distinguished in that the portion of the blank which is fixedly connected with the lateral surface of the respective container extends beyond the contact area of an envelope (around the entire arrangement of the containers) into the spaces of two oppositely located containers. This embodiment is of particular interest for containers with round cross sections, for example cans, bottles, or the like, because it is possible, for one, to create larger display surfaces and, for another, a comparatively greater stability of the bundle is created. In addition, less loose trash is created.

To make separation of the packaging between the individual containers easier, the connecting links have at least one tear line in accordance with the invention. A perforation line can be preferably used as a tear line. It is advantageous to design the packaging in such a way that each connecting link has two tear lines which separate the respective display area from the connecting link. Although a little more packaging trash is generated by this, the connecting link or a portion of the connecting link does not hamper the handling of the container.

For purposes of advertising, the blank can have an improved surface quality in the display area, because of which it is better possible to print the packaging material blank.

Alternatively to this it is provided in accordance with the invention that the blank has an additional display layer in the display area. It is possible to already apply this display layer in a simple way in the course of the production of the packaging material blank and to imprint it subsequently, so that the containers are packaged in an already printed blank.

In a suitable manner, the additional display layer is imprinted or attached by adhesion. It is possible in an advantageous manner to provide the display area with a glued on and already imprinted label, because of which the necessity for expensive printing of cardboard is avoided.

In accordance with a further embodiment of the present invention, the blank is not made of one piece, instead it consists of several individual sections, wherein respectively one section of the blank connects two adjoining containers.

The subject of claim 19 makes a simplified application by machine of the multiple packaging to the individual containers possible, because the alignment and adjustment steps required with multi-part blanks are no longer needed.

In addition, the invention relates to a process for packaging a plurality of containers, such as bottles, cans or bags, wherein the individual containers are at least partially enclosed by a one-piece or multi-piece packaging material blank and are maintained because of this so that they cannot be lost, particularly by the use of packaging in accordance with claims 1 to 19.

The process is distinguished in that the blank is fixedly connected with each container at least on one lateral surface, preferably is glued to it, whereby a display area which is fixedly disposed on the container is created and where loose, i.e. not glued sections of the blank remain between the individual display areas which act as connecting links, and that the blank can be separated in the area of the connecting links for opening the multiple packaging.

The individual containers are suitably enclosed in a single file row or in multi-sectional groups.

Several embodiments of the multiple packaging in accordance with the invention will be described in detail below.

DETAILED DESCRIPTION OF THE PREFERRED EMBODIMENTS

Figure 1:
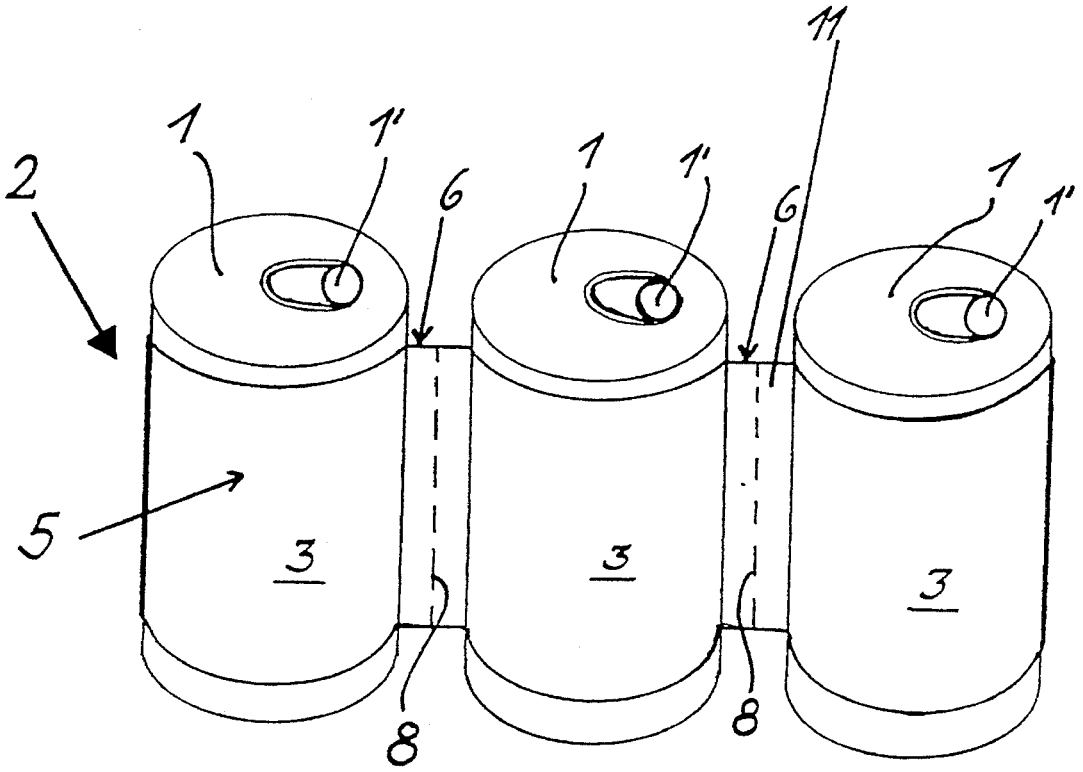
FIG. 1 a perspective view of multiple packaging, consisting of three containers, wherein the containers are arranged in a row in the longitudinal direction and the blank encloses the lateral areas of the containers of their entire circumference.

Multiple packaging 2 with a total of three containers 1 in the form of customary cans, for example cans of beverages, is shown in FIG. 1. On their tops, these containers each have an opening 1', which can be manually operated in a customary manner, for example by pressing it in or tearing it open.

The containers 1 are enclosed over their entire circumference along their lateral areas with a one-piece blank 5 made from cardboard (see FIG. 2), which is fixedly connected with the respective container 1, for example by gluing. From the start, the respective containers 1 do not have any labeling or the like, they are therefore neutral containers.

The area of the blank 5 fixedly connected with the respective container represents the so-called display area, which is provided with an advertisement and/or other information as needed. A connecting link 6 is located between the respective containers 1, which assures the cohesion of the individual container 1. In FIG. 1, the connecting links 6 are arranged in the longitudinal direction of the containers 1 and each one has a tear line 8 which eases the separation of the respective containers 1 at the end of the row.

For example, if the can shown on the right in FIG. 1 is separated from the total composite, only a bar 11 extending axially in relation to the can remains which, however, does not constitute an obstacle.

Figure 2:
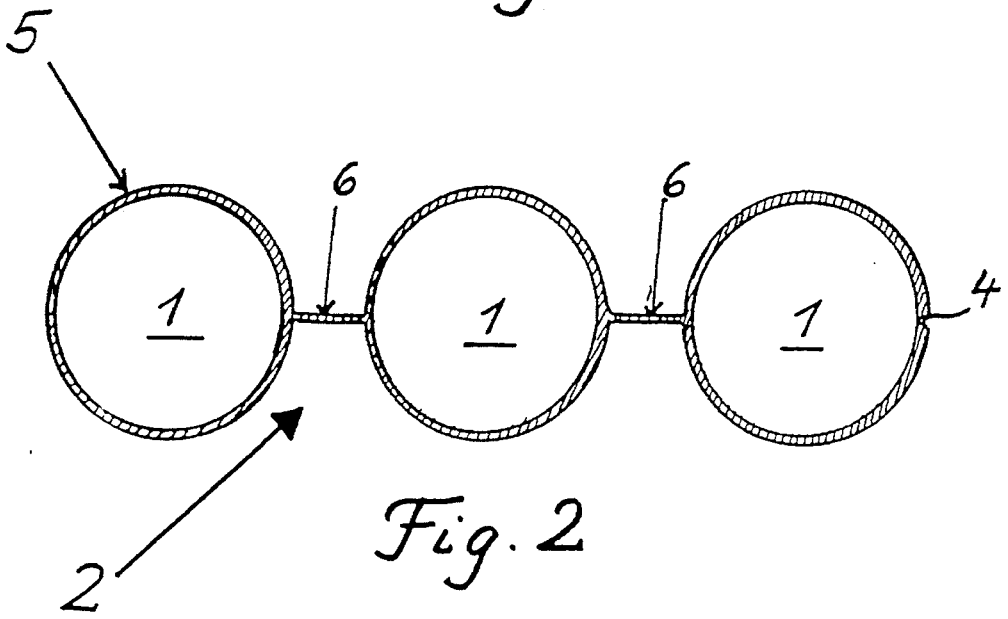
FIG. 2 a sectional view of the arrangement of FIG. 1.

It becomes clear from FIG. 2 that the blank 1 constituting the multiple packaging 2 encloses the three containers over their entire circumference, wherein in a one-piece blank 5 a joint 4 is formed on one side of the multiple packaging 2.

Figure 3:
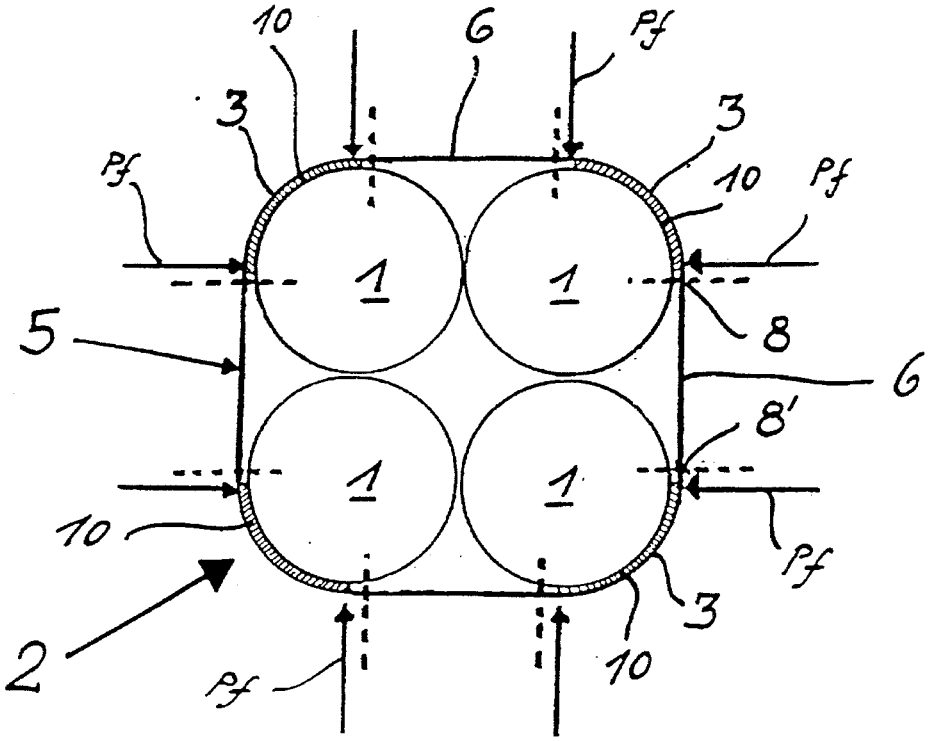
FIG. 3 a further suitable embodiment of the invention, wherein the blank encloses a multi-sectional composite of containers and wherein the containers touch each other.

A further embodiment of a multiple packaging 2 can be seen in FIG. 3, which contains a total of four containers 1 which mutually touch each other and are laterally enclosed by the blank 5. The blank 5 is fixedly connected with the containers 1 in the area of the contact surface with the exteriors, preferably glued to them (adhesive areas 10), by means of which the display areas, indicated by the reference numeral 3, are created.

The arrows Pf shown in FIG. 3 indicate that the four containers 1 are tied together under pressure. In this way a particularly stable bundle is created.

Furthermore, it can be seen from FIG. 3 that each connecting link 6 has two tear lines 8 and 8', one of these tear lines 8 and 8' being provided directly in the lateral area of the individual display areas 3, so that the respective containers 1 can be completely separated from the remaining multiple packaging 2.

Figure 4:
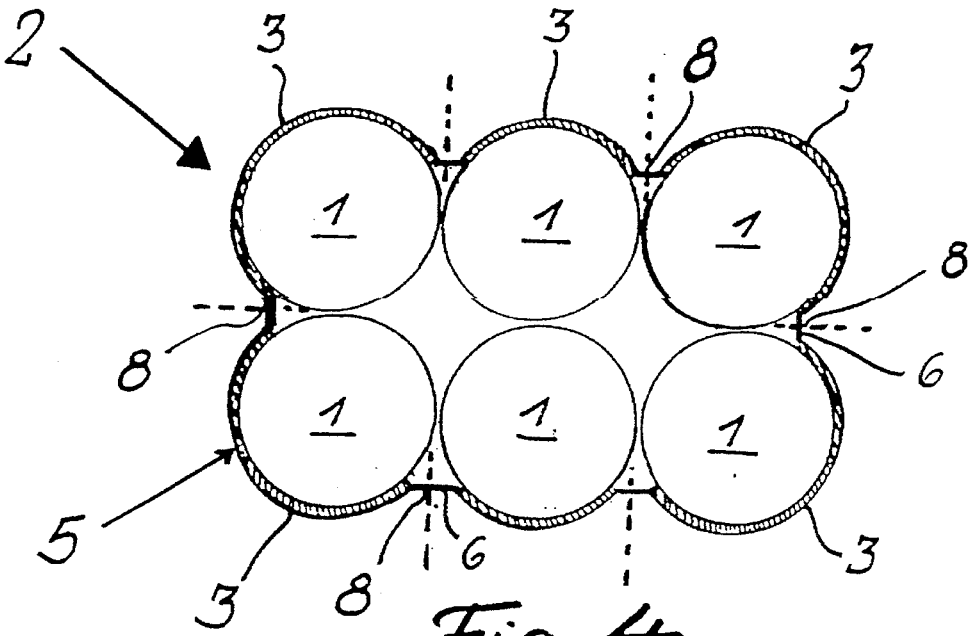
FIG. 4 a further multiple packaging in accordance with the invention, comprising a total of six containers.

The multiple packaging 2 illustrated in FIG. 4 encloses a total of six essentially directly adjoining containers 1. The portion of the blank 5 fixedly connected with the lateral area of the respective container 1, i.e. the display area 3, extends beyond the contact area of an envelope into the respective spaces between two oppositely located containers 1 and in this way forms a connecting link 6.

In this case the tear lines 8 are respectively formed in the center of the respective connecting link 6.

Figure 5:
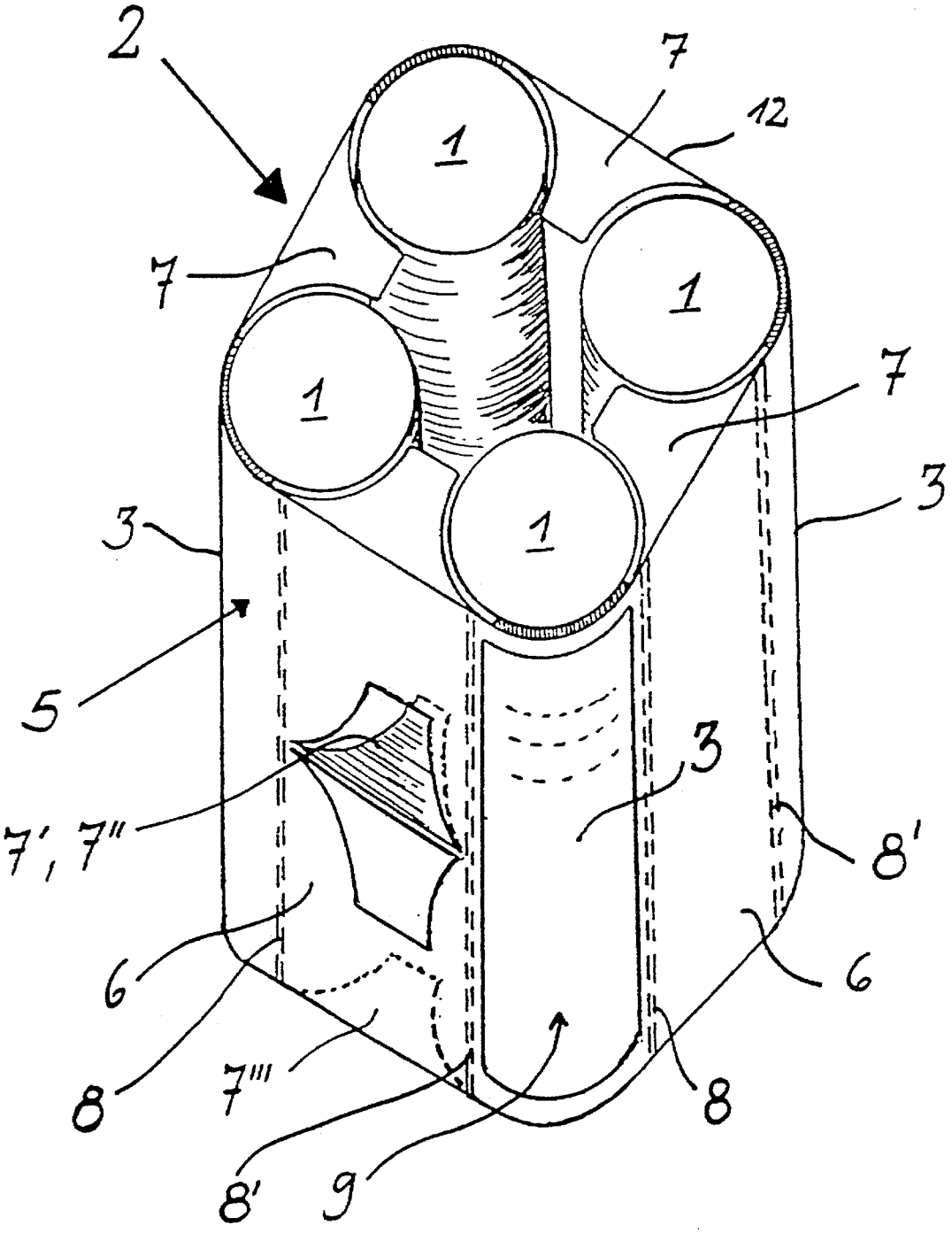
FIG. 5 multiple packaging consisting of four containers, wherein continuations of the blank are provided between adjoining containers for stabilizing the multiple packaging.
Figure 6:
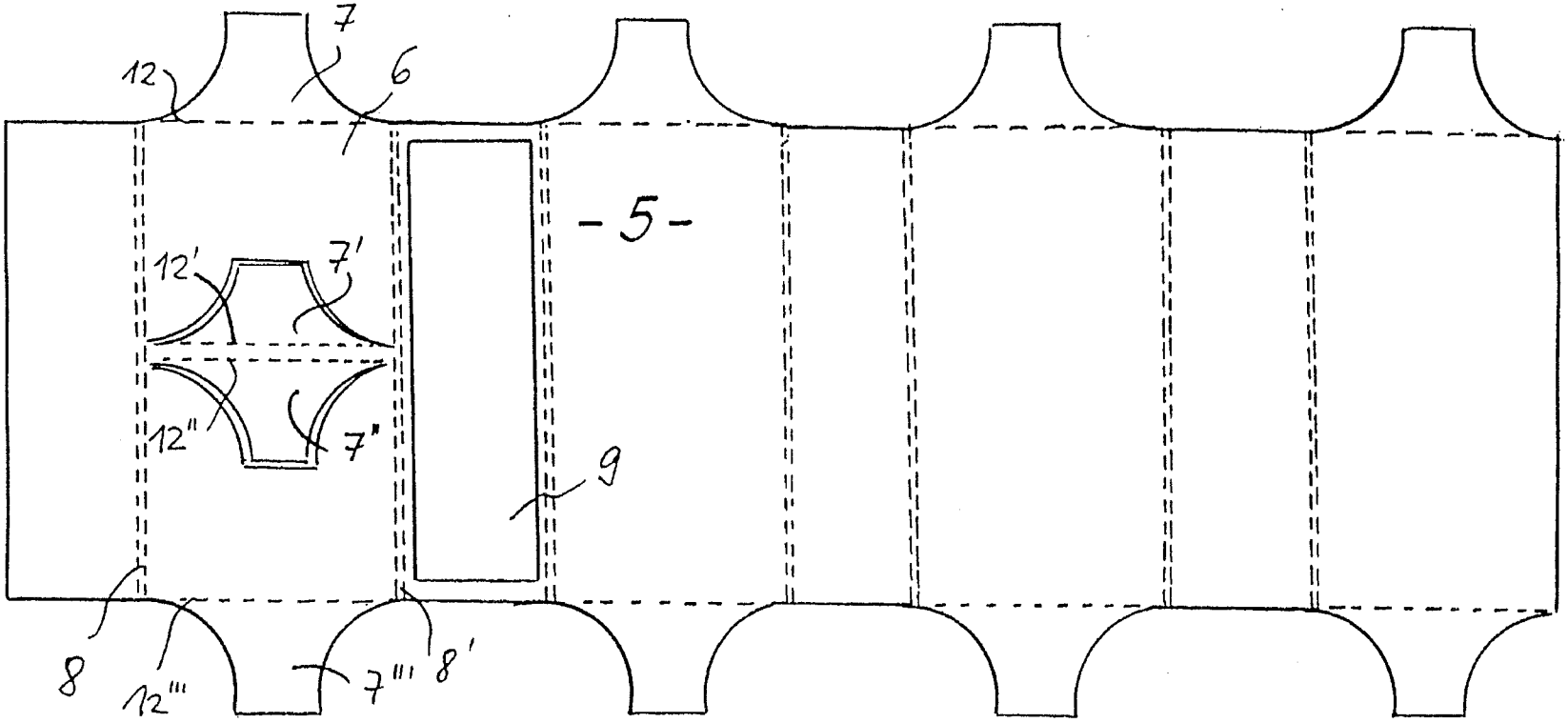
FIG. 6 a top view of the blank of the multiple packaging of FIG. 5.

The four containers 1 contained in the multiple packaging 2 illustrated in FIGS. 5 and 6 are arranged so that they are spaced apart from each other and, to make this packaging arrangement stable, the blank 5 has support straps 7, 7', 7" and 7'" which can be folded between the containers 1 which are spaced apart from each other. The support straps 7 and 7'" are respectively located at the lateral areas of the blank 5, while two further support straps 7' and 7" are provided in the interior of one of the connecting links 6. The two latter support straps 7' and 7" can be worked into the blank 5 in a simple manner by means of a stamping process. The individual support straps 7 to 7'" are preferably connected with the remaining blank 5 via bending lines 12, 12', 12" and 12'". The mirror-symmetrical arrangement of the support straps 7' and 7" in the respective connecting link 6 makes it possible for these two support straps to be folded on top of each other, which results in a further increase in stability. If necessary, the two support straps 7' and 7" can also be glued together.

The lateral flanks of the support straps 7 to 7'" have a contour which is adapted to the exterior of the respective container, so that an optimum support effect is created.

The tear lines indicated by 8 and 8' extend directly next to the respective display areas 3, so that after separation of the packaging the connecting links 6 can be completely separated from the individual containers 1.

Each display area 3 suitably has an improved quality surface in comparison to the remaining blank 5.

Alternatively to this is can also be provided that the respective display area 3, as illustrated in FIGS. 5 and 6, is provided with an additional display layer, for example in the form of a glued-on high-gloss layer, which is indicated by the reference numeral 9 and is only shown in connection with a single area in these drawing figures for the sake of simplicity.

Figure 7:
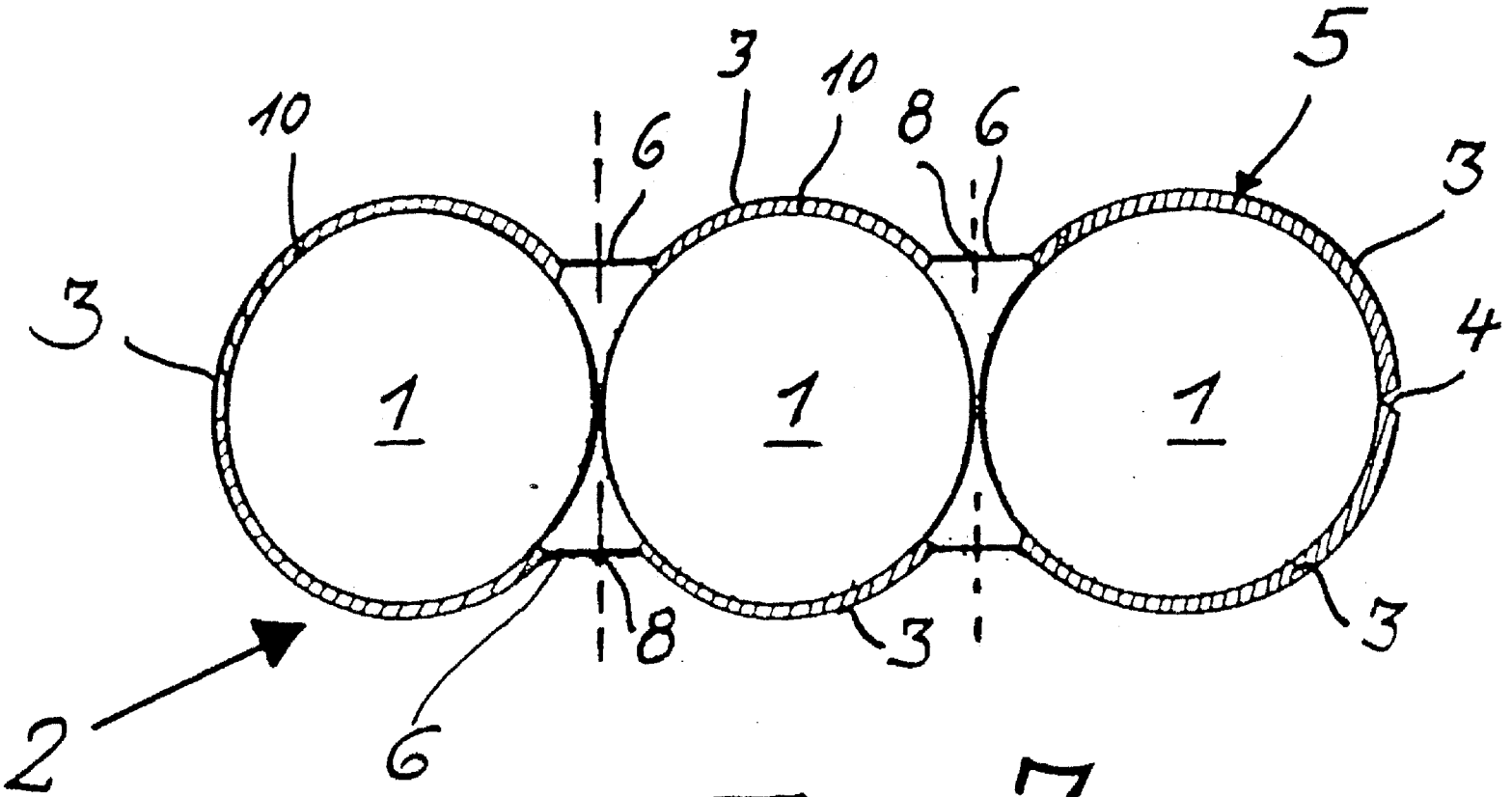
FIG. 7 a further exemplary embodiment of multiple packaging comprising a total of three containers, wherein the containers are arranged so that they directly adjoin each other laterally, similar to the embodiment of FIG. 4.

Finally, a further exemplary embodiment of a multiple packaging 2 can be seen in FIG. 7, in which a total of three containers 1 stand parallel next to each other and respectively are closely adjoined laterally. This is an embodiment of multiple packaging similar to that of FIG. 4, but with the difference that instead of six containers only three containers 1 are provided. The adhesive areas are again indicated by the reference numeral 10, through which predetermined portions of the blank 5 of the multiple packaging 2 are connected with the respectively associated surface areas of the individual containers 1. Again display areas 3 are defined by these adhesive areas on the respective exteriors of the resulting multiple packaging 2. Similarly to FIG. 4, the individual display areas 3 of this multiple packaging 2 are connected with each other by stabilizing connecting links 6, which practically extend in the area of spaces between two successive containers 1 and which are again supplied with tear lines 8 in their centers, so that the containers 1 can be easily separated from the packaged bundle.

Multiple packaging of the type illustrated is on the one hand distinguished by comparatively great stability, while on the other hand the packaging material trash can be reduced to a considerable extent.

I claim:

1. A package for a set of containers including a multiple packaging material, the containers having respective exterior curved surfaces, the containers being held in an arrangement wherein the containers are in at least pairwise mutual curved surface contact, the multiple packaging material comprising:

a packaging material blank, the blank further comprising contact areas disposed over respective contact regions, the contact regions being respective portions of the curved surfaces of each one of the containers, the respective portions extending through a respective arc around each one of the containers, and connecting link areas disposed between the contact areas, the connecting link areas not being in contact with the containers; and adhering means for fixedly adhering the contact areas onto the respective contact regions of the containers;

the blank being separable in the connecting link areas;

wherein at least one of the connecting link areas intermediate a pair of adjacent containers is displaced away from a line tangent to the contact areas of the adjacent containers, whereby the contact area extends into a space between two oppositely located containers.

2. The multiple packaging according to claim 1, wherein the packaging material is selected from the group consisting of cardboard and plastic.

3. The multiple packaging according to claim 1, wherein the containers are cylindrical.

4. The multiple packaging according to claim 1, wherein the arrangement is a single linear row of containers.

5. A package for or a set of containers including a multiple packaging material, the containers having respective exterior curved surfaces the containers being held in an arrangement wherein the containers are in at least pairwise mutual curved surface contact, the multiple packaging material comprising:

a packaging material blank, the blank further comprising contact areas disposed over respective contact regions, the contact regions being respective portions of the curved surfaces of each one of the containers, the respective portions extending through a respective arc around each one of the containers, and connecting link areas disposed between the contact areas, the connecting link areas not being in contact with the containers; and adhering means for fixedly adhering the contact areas onto the respective contact regions of the containers;

the blank being separable in the connecting link areas, wherein the respective portions include less than half of the respective curved surfaces as measured angularly relative to axes of the containers and the connecting link areas include tear lines.

6. The multiple packaging according to claim 1, wherein each of the connecting link areas includes a tear line.

7. The multiple packaging according to claim 1, wherein each of the connecting link areas includes two tear lines.

8. The multiple packaging according to claim 1, wherein selectively the contact area and the connecting link area further include a display area having an external surface quality adapted to include display indicia.

9. The multiple packaging according to claim 1, further comprising a display layer covering the display area.

10. The multiple packaging according to claim 1, wherein the display layer is glued on.

11. The multiple packaging according to claim 1, wherein the display layer is imprinted.

12. The multiple packaging according to claim 1, further comprising a plurality of the blank, and wherein each one of the plurality is in contact with at least two of the containers.

13. The multiple packaging according to claim 1, wherein the blank further comprises a single piece.

14. The multiple packaging according to claim 8, wherein the display layer coincides with the contact area and excludes the connecting link area.

* * * * *